US010099473B2

(12) United States Patent
Anderson et al.

(10) Patent No.: US 10,099,473 B2
(45) **Date of Patent: *Oct. 16, 2018**

(54) EVALUATING PRINT NOZZLE CONDITION

(71) Applicant: HEWLETT-PACKARD DEVELOPMENT COMPANY, L.P., Houston, TX (US)

(72) Inventors: Daryl E. Anderson, Corvallis, OR (US); Eric T. Martin, Corvallis, OR (US); Peter James Fricke, Corvallis, OR (US); James Michael Gardner, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/114,938

(22) PCT Filed: Jan. 30, 2014

(86) PCT No.: PCT/US2014/013706

§ 371 (c)(1),
(2) Date: Jul. 28, 2016

(87) PCT Pub. No.: WO2015/116072

PCT Pub. Date: Aug. 6, 2015

(65) Prior Publication Data

US 2017/0001433 A1 Jan. 5, 2017

(51) Int. Cl.

| | |
|---|---|
| ***B41J 2/165*** | (2006.01) |
| ***B41J 2/045*** | (2006.01) |
| ***B41J 2/14*** | (2006.01) |

(52) U.S. Cl.

CPC ..... *B41J 2/04508* (2013.01); *B41J 2/0451* (2013.01); *B41J 2/0458* (2013.01);
(Continued)

(58) Field of Classification Search

None

See application file for complete search history.

(56) References Cited

U.S. PATENT DOCUMENTS

| | | | |
|---|---|---|---|
| 5,255,021 | A | 10/1993 | Noguchi et al. |
| 6,533,382 | B1 | 3/2003 | Tomida et al. |

(Continued)

FOREIGN PATENT DOCUMENTS

| | | | |
|---|---|---|---|
| CN | 101823369 | A | 9/2010 |
| CN | 102729624 | A | 10/2012 |

(Continued)

OTHER PUBLICATIONS

Goepel et al.; The Ink Drop Sensor—A Means of Making Ink-Jet Printers More Reliable; IEEE; May 8-12, 1989; pp. 2-56-2-60.

Korean Intellectual Property Office, International Search Report and Written Opinion for PCT/US2014/013706 dated May 15, 2015 (14 pages).

*Primary Examiner* — Alejandro Valencia

(74) *Attorney, Agent, or Firm* — HP Inc.—Patent Department

(57) ABSTRACT

Systems and methods for evaluating the condition of a print nozzle are described. In one example, impedances across the print nozzle are measured. Subsequently, first test result and second test result are determined and registered at a first predetermined time instant and at a second predetermined time instant, respectively. The first test result and the second test result are obtained based on the measured impedances. Based on the first test result and the second test result, the condition of the print nozzle, is determined.

18 Claims, 8 Drawing Sheets

(52) U.S. Cl.
CPC ..... *B41J 2/04586* (2013.01); *B41J 2/14153* (2013.01); *B41J 2/16579* (2013.01); *B41J 2002/14354* (2013.01)

(56) References Cited

U.S. PATENT DOCUMENTS

| | | | | |
|---|---|---|---|---|
| 6,994,417 | B2 | 2/2006 | Murayama et al. | |
| 7,695,108 | B2 | 4/2010 | Silverbrook | |
| 8,336,981 | B2 | 12/2012 | Chen et al. | |
| 8,556,364 | B2 | 10/2013 | Hoisington et al. | |
| 2005/0231562 | A1* | 10/2005 | Torgerson | B41J 2/14072 347/65 |
| 2010/0049077 | A1* | 2/2010 | Sadleir | A61B 5/0002 600/547 |
| 2011/0084997 | A1 | 4/2011 | Chen et al. | |
| 2011/0085012 | A1 | 4/2011 | Nishikawa et al. | |
| 2013/0278656 | A1* | 10/2013 | Govyadinov | B41J 2/2142 347/9 |
| 2013/0278657 | A1 | 10/2013 | Martin et al. | |
| 2013/0320198 | A1 | 12/2013 | Govyadinov et al. | |
| 2014/0292857 | A1* | 10/2014 | Morton | B41J 2/04543 347/11 |

FOREIGN PATENT DOCUMENTS

| | | |
|---|---|---|
| WO | WO2012166119 | 12/2012 |
| WO | WO2013158099 | 10/2013 |

* cited by examiner

EVALUATING PRINT NOZZLE CONDITION

BACKGROUND

Inkjet printing involves releasing ink droplets onto a print medium, such as paper. The ink droplets bond with the paper to produce visual representations of texts, images or any other graphical content, onto the paper. In order to accurately produce the details of the printed content, nozzles in a print head accurately and selectively release multiple ink drops. Based on movement of the print head relative to the printing medium, the entire content is printed through the release of such multiple ink drops. Over a period of time and use, the nozzles of the print head may develop defects and hence would not operate in a desired manner. As a result, print quality may get affected.

BRIEF DESCRIPTION OF DRAWINGS

The detailed description is described with reference to the accompanying figures. In the figures, the left-most digit(s) of a reference number identifies the figure in which the reference number first appears. The same numbers are used throughout the figures to reference like features and components.

DETAILED DESCRIPTION

Figure 1A:
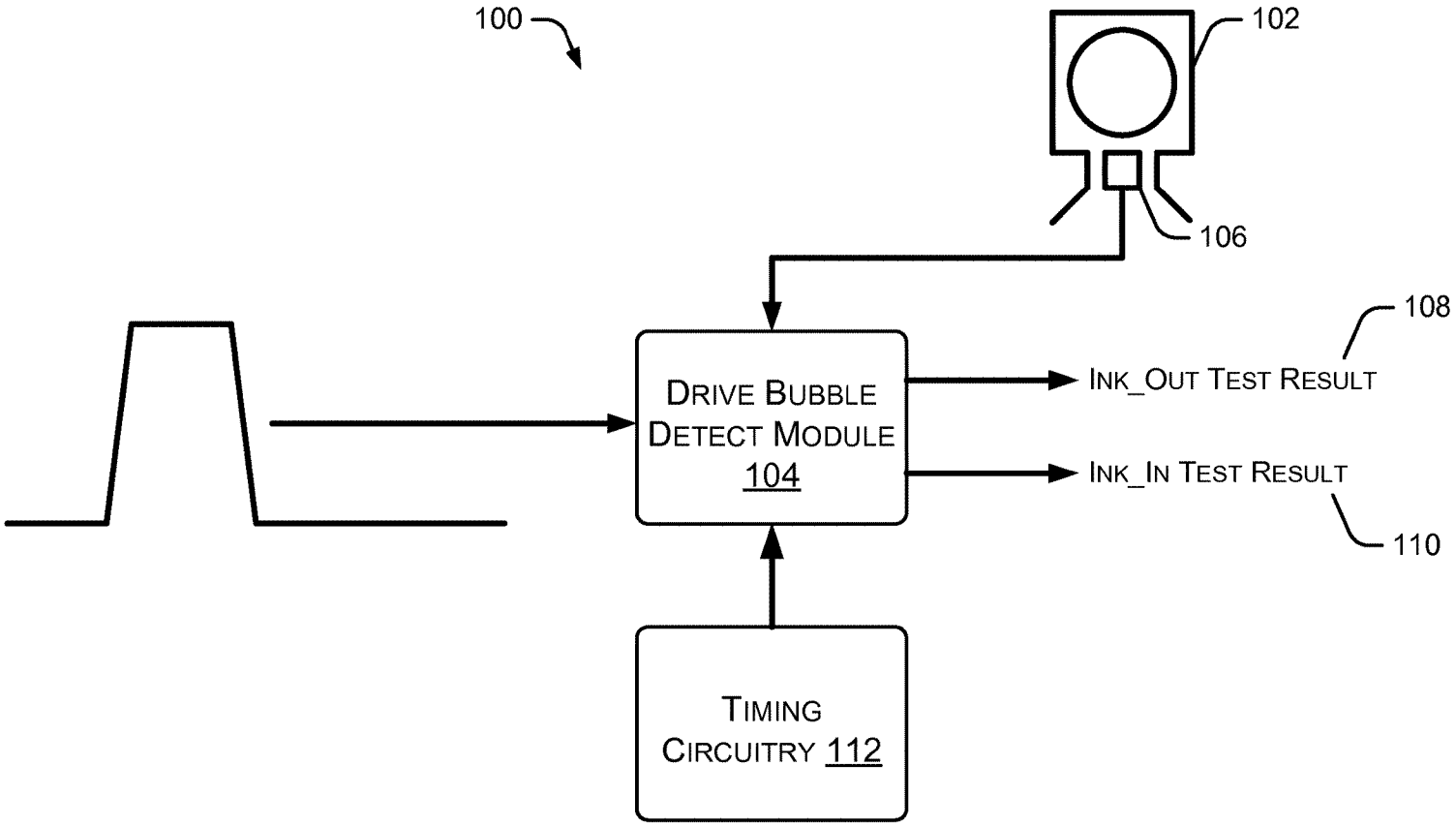
FIG. 1*a* illustrates a system for evaluating the condition of a print head nozzle, according to an example of the present subject matter.

Systems and methods for determining print head nozzle conditions of an inkjet printing system are described. Modern inkjet printing systems or printers print content on a print medium, such as paper. The printing is implemented by directing multiple drops of ink onto the print medium. The ink is directed through multiple nozzles positioned onto a print head of the printing system. The print head and the print medium move relative to each. For example, the print head may move laterally with the print medium being conveyed through a conveying mechanism. Depending on the content to be printed, the printing system determines the exact time instance and the position at which the ink drop is to be released onto the print medium. In this way, the print head releases multiple ink drops over a predefined area to produce a representation of the content to be printed. Besides paper, other forms of the printing medium may also be used.

The print head releases the ink drops through an array of nozzles provided on the print head. The ink eventually released from the nozzles is obtained from one or more ink chambers which are in fluid communication, i.e., connected through a plurality of pathways for delivering ink, with the nozzle. The ink chambers hold the ink and periodically release a predetermined amount to the nozzle, for printing.

When the print head is not printing, the ink is retained in the ink chamber due to capillary forces and/or back-pressure acting on the ink within the nozzle passage. The ink chamber is further provided with a heating element. In order to affect the release of an ink drop, the temperature within the chamber is increased. The increase in the temperature causes small volumes of ink to expand and evaporate. The evaporation of the ink results in the formation of a bubble within the ink chamber. The bubble, also referred to as a drive bubble, may further expand driving, or ejecting, an ink drop onto the print medium. As an ink drop is released, the bubble collapses with the dispensed ink drop volume subsequently getting replenished from the ink flow from the ink chamber.

It should be noted that the ink nozzle is subjected to such cycles of heating, drive bubble formations, drive bubble collapses and then replenishments of the ink supply. Over a period of time, and depending on other operating conditions, the ink nozzle within the print head may get blocked. The nozzle blocking may occur due to variety of factors. For example, particulate matter within the ink may cause the ink nozzle to get clogged. In other cases, small volume of ink may get solidified over the course of the printer's operation resulting in the clogging of the print nozzle. As a result, the formation and release of the ink drop may get affected. Since the ink drop has to form and be released at precise instances of time, any such blockages in the print nozzle are likely to have an impact on the print quality. Accordingly, in order to ensure that print quality is maintained, the condition of the print nozzle, i.e., whether it is blocked or whether it is experiencing other issues such as a deprimed chamber, is determined.

In cases where such a situation is preempted, appropriate measures such as servicing or nozzle replacements may be performed much in advance without affecting the print quality of the printer under consideration. The condition of the print nozzle is monitored and determined through logical circuitry. Such logical circuitry involves providing a sensor on the print nozzle. The sensor may be used for detecting presence or absence of a drive bubble. For example, any ink volume present in the print nozzle will offer less electrical impedance to the current provided by the sensor. Similarly, at the time when the drive bubble is present, air within the drive bubble will offer a high resistance as compared to the resistance offered by the ink volume.

Depending on the measurements of impedance, and the corresponding voltage variations due to the ink within the ink chamber, it may be determined whether the drive bubble has formed or not. In this manner it can be determined whether the drive bubble is being formed thereby providing an indication whether the print nozzle is operating in the desired manner. Furthermore, through the nozzle sensor, it may also determined whether at any one or more specific instances of time a drive bubble has formed or not. For example, any blockage in the print nozzle will also affect the formation of the drive bubble at any specific instance of time. In that case, if at a particular instance of time a drive bubble has not formed, it may be gathered that the nozzle is blocked and not working in the intended manner. Similarly, such a sensor-based mechanism may also determine whether at a different instance of time, the drive bubble has collapsed or not. In such a case, the ink has usually been replenished and will be detected by the nozzle sensor. If the drive bubble had not collapsed at a predetermined instance of time, it can also be gathered that the nozzle has become defective.

The print head may be accompanied with circuitry which assists in implementing the functionality of the print head. The sensor based mechanisms as described above, may operate based on signals generated by the sensors. Such signals are communicated off the print head circuitry, or off-chip or off the print die. The signals may be communicated to the processing unit of the printer for processing so as to determine the condition of the print nozzle. In such cases, communicating such signals off-chip to the processing unit or to other components of the printer may require bandwidth. Furthermore, communicating the sensor signals off-chip may introduce timing issues which might affect the accuracy of such determinations. The processing of the sensor signals may also be done on-chip but such an implementation may require complex circuitry and might be intensive in terms of both space within the printer and in terms of cost.

Systems and methods for evaluating print head nozzle conditions are described. In one example, method for determining the print head nozzle condition is described. The method, as per the present subject matter, is further implemented through a minimal, circuitry implemented onto the print head, for determining the print nozzle condition. Furthermore, the determination of the nozzle condition is done on-chip using the minimal circuitry, as opposed to off-chip, thereby reducing the overheads on the processing unit of the printer, and also reducing the demand on bandwidth for communicating condition relation information to different components of the printer. Furthermore, the minimal circuitry, as per one example, is implemented using a plurality of logic-based components making such system less complex.

As per an example of the present subject matter, a sensor is provided within the print nozzle. The sensor may be an impedance sensor. Such a sensor may determine the variations in the impedance with respect to a threshold, depending on the current passing through a sensed medium, which is the ink in the ink chamber. During operation, the print nozzle releases or fires one or more ink drops onto the print medium to print the desired content. The release of the ink drop may be based on one or more signals received by the print processor. In one example, the print nozzle is activated based on a pulse, referred to as a firing pulse. The firing pulse provides an indication to the print nozzle to fire or release the ink drop onto the print medium.

As mentioned previously, a print nozzle may further include one or more heating elements. Due to the heating elements, a drive bubble is formed which then ejects the ink drop from the print nozzle. Once the firing pulse is received, the print head starts to prepare for releasing the ink drop. To this end, a heating element is activated which forms the drive bubble within the ink chamber. As the heating element heats the ink within the ink chamber, a drive bubble is formed. Due to the action of the heating element, the drive bubble would continue to expand till an ink drop is ejected from the ink nozzle. Once the ink drop is ejected, the drive bubble collapses and the ink supply is replenished for subsequent firing.

Due to the formation and the collapsing of the drive bubble, the impedance would vary as the drive bubble is being formed. The impedance variations are measured through the sensor positioned within the print nozzle. The impedance variations are measured at specific instants after certain time intervals have elapsed with respect to the firing pulse. The variations may be measured with respect to either the rising edge or falling edge of the firing pulse. Depending on the impedance variations which are measured at the specific time instants, a determination is made to assess whether the print nozzle is functioning in the desired manner.

In one example, the impedance variations are measured at least at a first predetermined time instant and at a second predetermined time instant, with respect to a predefined threshold. As mentioned previously, the first and the second predetermined time instants are measured with respect to either the rising or falling edge of the firing pulse.

Continuing with the present example, the first predetermined time instant may correspond to a time at which, after the firing pulse, a drive bubble has formed. In such a case, if the impedance measured is high with respect to a threshold at such time instant, it may be concluded that the drive bubble had formed in the appropriate manner. If, however, variations had occurred at the first predetermined time instant, say that the impedance measured increased from low to high with respect to a threshold, it may be concluded that the print nozzle is blocked. In a similar manner, if the impedance measured varied from high to low, it may be concluded that the drive bubble formed was weak.

As the process continues, the drive bubble will force the ink drop out of the print nozzle, and will collapse. The volume of ink expended by the print nozzle is further replenished through an ink reservoir. As a result, the ink is again brought in contact with the sensor. Consequently the impedance measured would be less. In one example, it is determined whether such a variation occurs at the second predetermined time instant. If the variation did perhaps occur by the second predetermined time instant, it may be concluded that the print nozzle is functioning properly. If however, the variation occurred beyond the second predetermined time instant, the same may be indicative of either a blocked nozzle or presence of a stray bubble.

As per an example of the present subject matter, the variations in the impedance across the print nozzle are measured and converted to one or more logical output signals, for example, in the form of a binary output. The logical output signals are obtained by processing the signals associated with the impedance variations through a minimal logical circuitry provided on the print head. The logical output signals are subsequently registered or latched onto the components of the minimal circuitry. In the foregoing example, the minimal circuitry implemented onto the print die may register the logical output signals at the first predefined time interval and the second predefined time interval. Based on the logical output signals, the condition of the print nozzle may be evaluated. The logical output signals may be series of 0's and 1's which would indicate whether the condition of the print nozzle is healthy or not.

Continuing with the present example, the logical output itself indicates the condition of the print nozzle. For example, the logical output signals represented as a combination of 0's and 1's, may be mapped to different indicative conditions of the print nozzle. Depending on what the logical output is, the condition of the print nozzle is evaluated based on the mapping. No further processing is required for processing the logical output signals. As a result, the logical output signals need not be communicated, say, to a processor of the printer, to determine the print nozzle condition. In this manner, use of resources to communicate and process signals indicating print nozzle conditions may be avoided. Furthermore, since the circuitry for determining the condition of the print nozzle is implemented using a plurality of logical-based components, the resulting circuitry is less complex.

The above methods and systems are further described with reference to FIGS. 1 to 6. It should be noted that the description and figures merely illustrate the principles of the present subject matter. It is thus understood that various arrangements may be devised that, although not explicitly described or shown herein, embody the principles of the present subject matter. Moreover, all statements herein reciting principles, aspects, and embodiments of the present subject matter, as well as specific examples thereof, are intended to encompass equivalents thereof.

FIG. 1*a* illustrates a system 100 for determining print head nozzle conditions, according to an example of the present subject matter. The system 100 as described is implemented within circuitry of a print head of a printer. The system 100 includes a print nozzle 102 coupled to a drive bubble detect module 104. The print nozzle 102 further includes a sensor 106 provided within the print nozzle 102. The sensor 106, as per an example, may be an impedance sensor or a voltage sensor. As will be explained subsequently, the sensor 106 measures the variations in impedances which occur due to the formation or collapse of a drive bubble, at one or more specific instants of time. Based on the measured impedances, the drive bubble detect module 104 provides the output test results as logical signals, namely ink_out test result 108 and ink_in test result 110. In one example, the sensor 106 measures a voltage across the print nozzle. The impedance or the voltage is measured by passing a current through the ink volume present in the print nozzle. Since the ink is a conducting medium, the ink provides less impedance to a current. Once the drive bubble is formed, the impedance offered would be high. Consequently, the voltage across the print nozzle would be low and high, respectively.

A printing process may be initiated through a firing pulse. On receiving the firing pulse, a heating element (not shown) within the print nozzle 102 may start heating the ink, thereby resulting in the formation of a drive bubble. Prior to the forming of the drive bubble, the ink being in contact with the sensor 106 will provide low impedance. When the drive bubble has formed, the ink ceases to be in contact with the sensor 106, and thus the impedance measured would be consequently high.

The drive bubble detect module 104 determines the impedance at one or more certain time instants. The timing for measuring the impedances are managed and controlled by timing circuitry 112. The time instants are determined after a predefined time has elapsed from the occurrence of the firing pulse. In one example, the drive bubble detect module 104 measures the impedance at time instants prescribed by a first predetermined time instant and second predetermined time instant.

While measuring the impedance across the print nozzle, the drive bubble detect module 104 may compare the measured impedance with respect to a threshold impedance, at the first predetermined time instant. In one example, the timing circuitry 112 may activate the drive bubble detect module 104 so that the measure impedance is captured or registered at the occurrence of the first predefined time instant. The drive bubble detect module 104 may include one or more latches for registering and providing the outcome. For registering, the measured impedance is stored in the latches.

For a properly functioning print nozzle, a drive bubble would have formed by the first predetermined time instant. Consequently, the impedance measured across the print nozzle 102 should be high. In case the drive bubble detect module 104 determines that the impedance variation has occurred by the first predetermined time instant, it may be concluded that the drive bubble either did not form properly or was weak, i.e., collapsed prematurely. On the other hand, if the drive bubble detect module 104 determined that the impedance measured was high and no variations in the measured impedance occur with respect to the threshold impedance, the print nozzle would be considered as healthy and functioning properly. The determination of the drive bubble detect module 104 may be represented as a test result. Since the present test result corresponds to a state where the ink flows out of the print nozzle 102, the test result may be referred to as an ink_out test result 108.

The drive bubble detect module 104 further may also compare the measured impedance with respect to the threshold impedance, at the second predetermined time instant. In one example, the timing circuitry 112 may activate the drive bubble detect module 104 so that the measure impedance is captured or registered at the occurrence of the second predefined time instant. The drive bubble detect module 104 may include a second set of latches for registering and providing the outcome.

For a properly functioning print nozzle, a drive bubble would have collapsed after the second predetermined time instant. Consequently, the impedance measured v would vary from high to low, as the ink is replenished within the ink chamber. It should be noted that in such, a case, ink flows into the print nozzle 102. In case the drive bubble detect module 104 determines that the impedance variation has occurred by the second predetermined time instant, it may be concluded that the drive bubble did collapse, and that the ink supply within the print nozzle was replenished, in a timely manner. If however, the drive bubble detect module 104 determines that the variation occurs beyond the second predetermined time instant, it may be concluded that the print nozzle 102 is either blocked or that a stray drive bubble is present within the print nozzle 102, and provides the result of such a determination as an ink_in test result 110.

In order to evaluate the condition or health of the print nozzle 102, both the ink_out test result 108 and the ink_in test result ink_in test result 110 are used. For example, only when both ink_out test result 108 and the ink_in test result 110 are indicating that the drive bubble formed and collapsed in a timely manner, would the print nozzle 102 be considered as healthy. In another example, the ink_out test result 108 and the ink_in test result 110 may be communicated to a processing unit of a printer (not shown) for further implementing one or more remedial action, if required, in response to the ink_out test result 108 and the ink_in test result 110. The ink_out test result 108 and the ink_in test result ink_in test result 110 in one example, may be in a binary form.

Figure 1B:
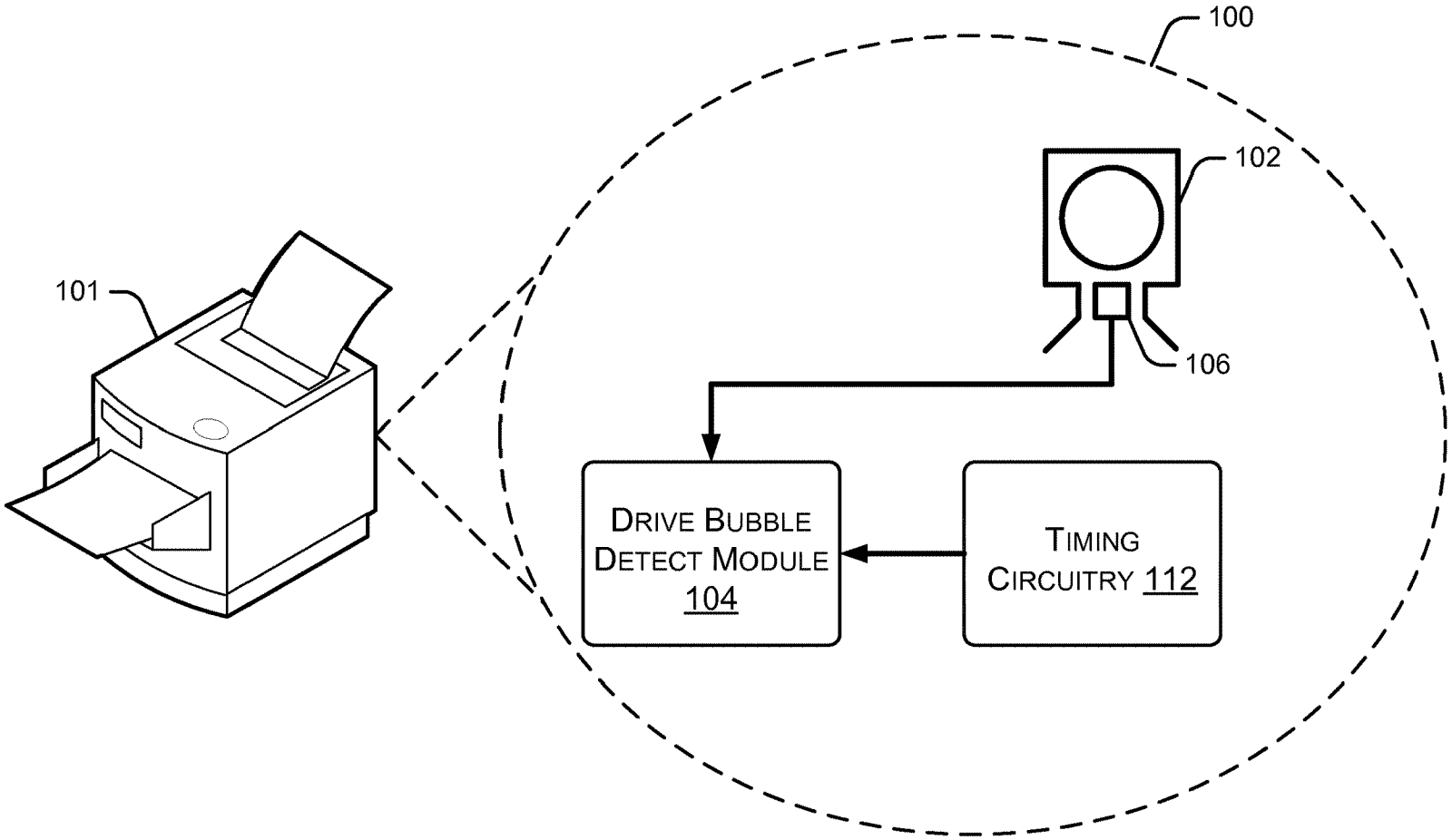
FIG. 1*b* illustrates a printer incorporating a system for evaluating the condition of a print head nozzle, according to an example of the present subject matter.

FIG. 1*b* illustrates a printer 101 implementing a system for evaluating the condition of a print head nozzle, according to an example of the present subject matter. As illustrated, the system for evaluating the condition of a print head nozzle, such as the system 100, is implemented within the printer 101. In another example, the drive bubble detect module 104 is implemented onto the print head of the printer 101.

Figure 1C:
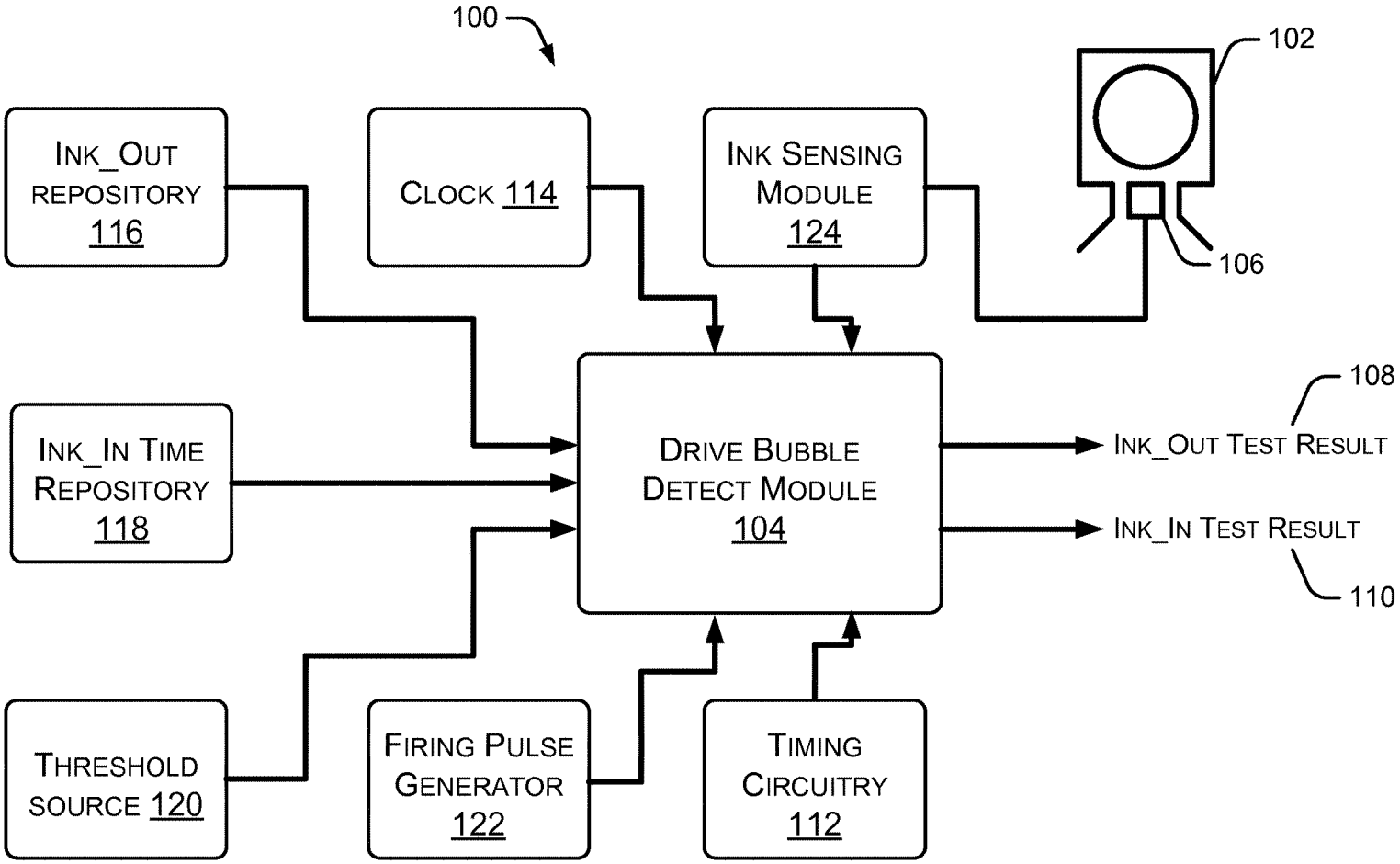
FIG. 1*c* illustrates another system for evaluating the condition of a print head nozzle, according to yet another example of the present subject matter.

FIG. 1*c* illustrates a system 100 for evaluating the condition of a print head nozzle, according to another example of the present subject matter. The system 100 as described is implemented within circuitry of a print head of a printer, such as the printer 101. The system 100 includes a print nozzle 102 coupled to a drive bubble detect module 104. The print nozzle 102 further includes a sensor 106 provided within the print nozzle 102. In one example, the sensor 106 is a capacitative sensor and is configured to measure either impedance or voltage across the print nozzle. The system 100 further includes the timing circuitry 112, a clock 114, ink_out time repository 116, ink_in time repository 118, threshold source 120, a firing pulse generator 122 and an ink sensing module 124. Each of the above mentioned modules are coupled to a drive bubble detect module 104. Although not explicitly represented, each of the modules may be further connected to each other, without deviating from the scope of the present subject matter. The drive bubble detect module 104 based on the input received from one or more of the modules as illustrated, provides ink_out test result 108 and ink_in test result 110.

Figure 2:
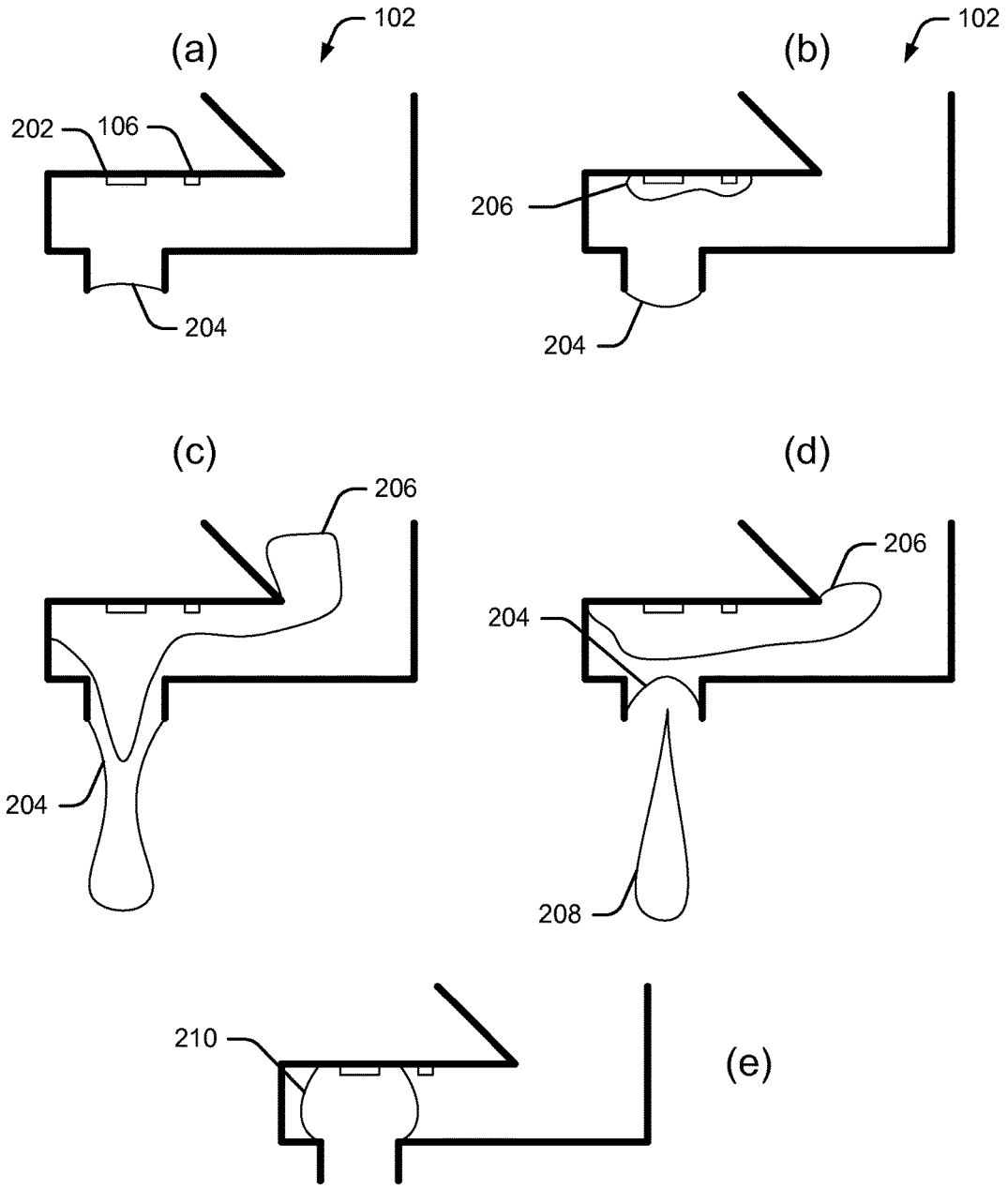
FIG. 2(*a*)-(*e*) provides cross-sectional illustrations of a print head with nozzle in various stages of a drive bubble formation, according to an example of the present subject matter.

The working of the system 100 is explained in conjunction with FIG. 2. FIG. 2 provides an illustration of the print nozzle 102 depicting the formation and the collapse of the drive bubble. As per the present example, the print nozzle 102 includes a heating element 202 and the sensor 106. Through the action of the heating element 202, the sensor 106 may monitor the variations in the impendence measured across the print nozzle 102 due to the formation of the drive bubble 206.

Continuing with the present example, the print nozzle 102 prepares for ejecting one or more ink drop based on a fire pulse received from the firing pulse generator 106. Prior to receiving the firing pulse, the ink is retained within the print nozzle 102 due to capillary action, with the ink level 204 contained within the print nozzle 102. On receiving the firing pulse, the heating element 202 initiates heating of the ink in the print nozzle 102. As the temperature of the ink in the proximity of the heating element 202 increases, the ink may evaporate and forming a drive bubble 206. As the heating continues, the drive bubble 206 expands and forces the ink level 204 to extend beyond the print nozzle 102 (as depicted through FIGS. 2(*a*)-(*c*), as per one example of the present subject matter).

As also mentioned previously, the ink within the print nozzle 102 would offer certain electrical impedance to a specific electrical current. Typically, mediums such as ink are good conductors of electric current. Consequently, the electrical impedance offered by the ink within the print nozzle 102 would also be less. As the print nozzle 102 prepares for ejecting one or more ink drops, the sensor 106 may pass a finite electrical current through the ink within the print nozzle 102. The electrical impedance or the voltage across the print nozzle 102 may be measured through the sensor 106. The following description has been presented with respect to a measured voltage across the print nozzle 102, without deviating from the scope of the present subject matter.

In one example, as the drive bubble 206 forms due to the action of the heating element 202, the ink in the proximity of the sensor 106 may lose contact with the sensor 106. As the drive bubble 206 forms, the sensor 106 may get completely surrounded by the drive bubble 206. At this stage, since the sensor 106 is not in contact with the ink, the impedance, and therefore the voltage measured by the sensor 106 would be correspondingly high. The voltage measured by the sensor 106 would register a constant value during the time interval the sensor 106 is not in contact with the ink. As the drive bubble 206 expands further, the physical forces arising out of the capillary action would no longer be able to hold the ink level 204. An ink drop 208 is formed which then separates from the print nozzle 102. The separated ink drop 208 is thus ejected towards the print medium, as depicted through. Once the ink drop 208 is ejected, ink in the print nozzle 102 is replenished by the incoming ink flow from a reservoir. At this stage the heating element 202 also ceases to heat the ink within the print nozzle 102. As the ink is replenished, the drive bubble 206 collapses to result into a space 210, thereby restoring the contact with the sensor 106, as is depicted in FIG. 2(*e*).

The sensor 106 measures the variations in the voltage that occur during the course of drive bubble 206 formation and collapse. The voltage across the print nozzle 102 will remain low at instants when ink is present and the drive bubble 206 is not present, and will be high when the drive bubble 206 is present. While the drive bubble 206 is forming and when the drive bubble 206 has collapsed, the voltage measured by the ink sensing module 124 would vary. As per an example of the present subject matter, the variations in the drop across the print nozzle 102 are measured by the ink sensing module 124 at specific time instants. The specific time instants are measured after a predefined time has, elapsed after the occurrence of a firing pulse. The specific time instants may be representative of the time instants at which the ink would be present and not present in the print nozzle 102.

In one example, the specific time instants may include a first predetermined time instant and a second predetermined time instant. The first predetermined time instant may correspond to a point in time when the drive bubble 206 has formed, i.e., when the ink has been or is in the process of being dispensed from the print nozzle 102. The first predetermined time instant, as per an example, is referred to as an ink_out time. Furthermore, as the drive bubble 206 expands and the ink drop is dispensed from the print nozzle 102, the drive bubble 206 will collapse thereby restoring contact with the sensor 106. As a result, the voltage will vary, i.e., will decrease over a period of time. The drive bubble detect module 104 determines the voltage at the second predetermined time instant. Since during the present stage, the ink flow is incident into the print nozzle 102, the second predetermined time instant is referred to as the ink_in time. The ink_in time and the ink_out time is stored within ink_out time repository 116 and ink_in time repository 118, as per one example.

Continuing with the present example, the voltage across the print nozzle 102 is measured after the firing pulse has been initiated. In one example, the voltage is at instants measured with respect to the falling edge of the firing pulse. At the instance when the falling edge of the firing pulse occurs, the ink sensing module 124 measures the voltage across the print nozzle 102. In one example, when the falling edge of the firing pulse occurs, the drive bubble 206 may have formed, or may be in the process of being formed. At this stage, the ink within the print nozzle 102 is not in contact with the sensor 106. As a result, the measured voltage would be correspondingly high. The drive bubble detect module 104 subsequently obtains the ink_out time from the ink_out time repository 116. As mentioned previously, the ink_out time specifies the time at which the drive bubble 206 would have formed for a properly functioning print nozzle 102.

On obtaining the ink_out time from the ink_out time repository 116, the drive bubble detect module 104 obtains the voltage across the print nozzle 102 from the ink sensing module 124. The drive bubble detect module 104 then determines and compares the voltage across the print nozzle 102 at the instant prescribed by the ink_out time, with a threshold voltage. Depending on whether the voltage is high, the drive bubble detect module 104 may determine whether the print nozzle 102 is functioning in the desired manner. For example, the voltage across the print nozzle 102 being less than the threshold voltage, would indicate that the drive bubble 206 either formed late or did not form at all, which in turn would indicate that the print nozzle 102 is blocked. The ink_out time is determined with respect to the instance when the falling edge of the firing pulse occurs. In one example, the time elapsed from the instance of the falling edge of the firing pulse, may be measured through a clocked signal provided by the clock 114. In another example, the drive bubble detect module 104 provides an output indicating the determination for the ink_out time as ink_out test result 108.

The drive bubble 206 formed would continue to expand till an ink drop 208 is formed and ejected from the print nozzle 102. When the ink drop 208 is ejected, the drive bubble 206 would collapse and the ink would again come in contact with the sensor 106. As a result, the voltage measures across the print nozzle 102 would also drop. The drive bubble detect module 104 determines whether the variation in the voltage occurs, i.e., the voltage measured across the print nozzle 102 is lower than the threshold voltage at a second predefined time instant. In one example, the drive bubble detect module 104 determines whether the voltage variation, occurring due to the collapsing of the drive bubble 206, occurs by the time instant prescribed by the ink_in time. The ink_in time may be obtained from the ink_in time repository 118.

Based on the voltage determined at the ink_in time, the drive bubble detect module 104 determines whether the print nozzle 102 is working in the desired manner. For example, if the voltage across the print nozzle 102 does not change, i.e., remains high, it may be concluded that the drive bubble 206 has persisted within the print nozzle 102 for a longer time period. This typically occurs when an ink drop, say ink drop 208 takes a longer time to form particularly due to a blocked nozzle. It may also be the case, that a stray bubble has a perhaps formed within the print nozzle 102.

If however the drive bubble detect module 104 determines that the voltage across the print nozzle 102 has is less than the threshold voltage at the ink_in time, it may be concluded that the print nozzle 102 is working in the desired manner. In one example, the drive bubble detect module 104 provides an output indicating the determination for the ink_in time as ink_in test result 110. In one example, both the ink_out test result 108 and the ink_in test result 110 are considered for determining whether the print nozzle 102 is functioning in the proper manner. In another example, the voltage across the print nozzle 102 may be determined with respect to a threshold voltage, provided by threshold source 120.

In yet another example, the timing circuitry 112 may be employed for measuring impedances at the ink_out time instant and the ink_in time instant. In such a case, the timing circuitry 112 may measure the time that as elapsed from the occurrence of the firing pulse based on a clocked signal from clock 114. Once the time as prescribed by the ink_out time has been reached, the timing circuitry 112 may activate the drive bubble detect module 104 to determine a logical output based on the voltage measured at the ink_out time instant. The logical output may be determined based on the comparison between the voltage measured and a threshold voltage.

The logical output may be registered within the drive bubble detect module 104 as the ink_out test result 108. In another example, the drive bubble detect module 104 may further include one or more latches which stores ink_out test result 108. Similarly, the timing circuitry 112 may also monitor the time using the clocked signal from clock 114. As the time instant prescribed by the ink_in time occurs, the timing circuitry 112 may further activate the drive bubble detect module 104 to determine another logical output and store the same. In an example, the another logical output may be stored as the ink_in test result 110.

Figure 3:
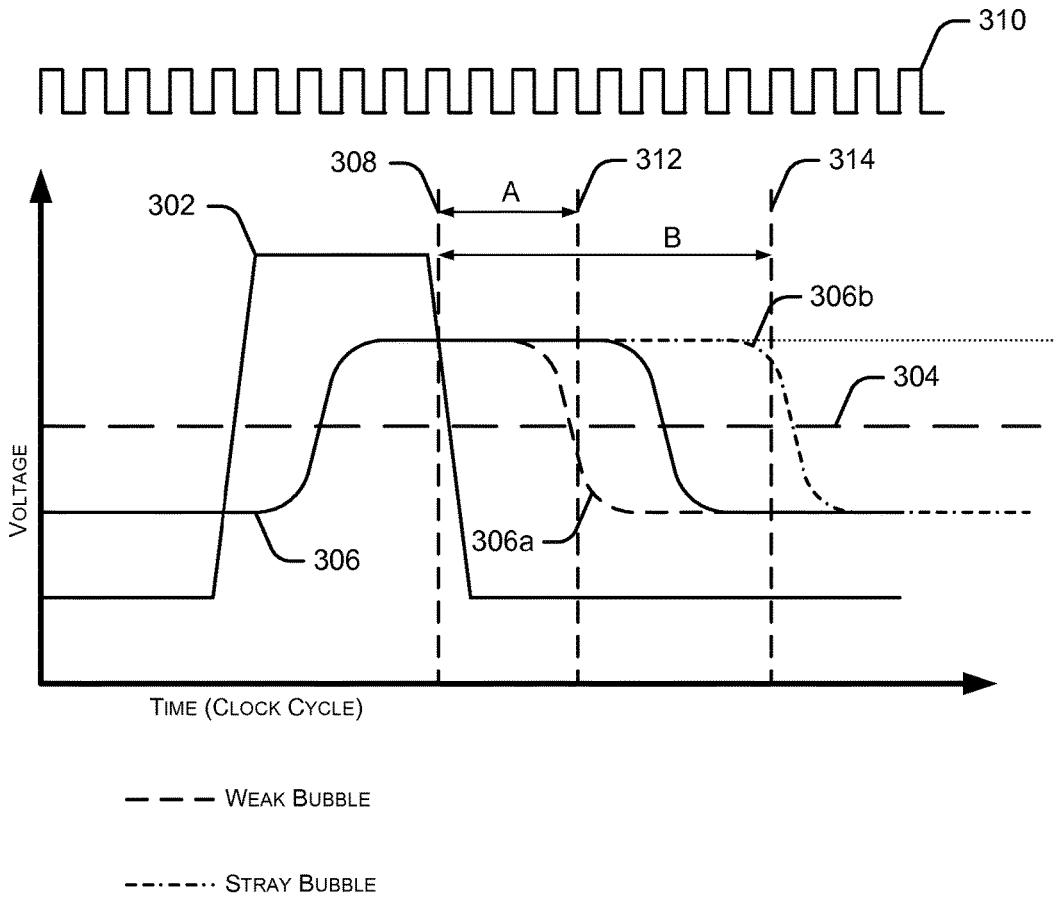
FIG. 3 graphically illustrates voltage variations across a print nozzle in various stages of drive bubble formation, according to an example of the present subject matter.

FIG. 3 provides a graphical representation 300 depicting the variations in the voltage measured across the print nozzle 102, as per one example of the present subject matter. Furthermore, the graph 300 is only provided for sake of illustration and should not be construed as a limitation. Other graphs depicting such variations would also be within the scope of the present subject matter. The graph 300 depicts a firing pulse 302 and a threshold voltage 304. The threshold voltage 304 may be provided by a source such as threshold source 120. The variations in the voltage occurring at the print nozzle 102 are indicated by the graph 306. In operation, the printing process is initiated by the firing pulse 302. Prior to the firing pulse 302, the ink is present in the print nozzle 102. Since the ink offers low impedance to a current provided by the sensor 106, the voltage 306 across the print nozzle 102 is also low. As the process initiates a drive bubble, such as drive bubble 206, forms thereby increasing the voltage 306 across the print nozzle 102.

The drive bubble detect module 104, on the falling edge of the firing pulse 302, determines and compares the voltage 306 at instants as prescribed by the ink_out time and ink_in time with the threshold voltage 304. In one example, the drive bubble detect module 104 starts monitoring the voltage 306 at the instance 308. The drive bubble detect module 104 measures the voltage 306 with respect to the threshold voltage 304, at the ink_out time. The time period as prescribed by the instant ink_out time is depicted by instant 312. In one example, determining the duration (as depicted by A) whether the ink_out time has elapsed may be measured through the clocked signal 310 provided by the clock 114. The voltage 306 is measured by the ink sensing module 124 and provided to the drive bubble detect module 104.

The drive bubble detect module 104 compares the voltage 306 with the threshold voltage 304 to determine whether the print nozzle 102 is working in a desired manner. For example, if the voltage 306 does not vary with respect to the threshold voltage 304 and remains high, the drive bubble detect module 104 may provide an ink_out test result 108 as positive indicating that the drive bubble 206 is being or has formed properly. If however, at the ink_out time, the voltage 306 is below or less than the threshold voltage 304 (as depicted by graph 306*a*), the drive bubble detect module 104 may determine that the drive bubble 206 formed was weak or not properly formed. The ink_out test result 108 may be provided as a binary value, i.e., either as a 0 or 1. For example, an ink_out test result 108 of 0 may be indicative of a formation of a weak drive bubble 206. On the other hand, an ink_out test result 108 as 1, may indicate that the drive bubble 206 formed was proper.

The drive bubble detect module 104 further compares the voltage 306 measured by the ink sensing module 124, with the threshold voltage at a second predetermined time instant. In one example, the drive bubble detect module 104 compares the voltage 306 at the time instant ink_in time, with the threshold voltage 304. The ink_in time, as illustrated in FIG. 3 (the duration which is shown as B) is depicted as the instant 314. At the ink_in time, the drive bubble detect module 104 determines whether the voltage 306 falls below the threshold voltage 304. As described in detail in the preceding paragraphs, the voltage 306 would increase when the drive bubble 206 collapses and the ink is again brought in contact with the sensor 106. If the decrease in the voltage 306 occurs by the ink_in time, the drive bubble detect module 104 may determine that the drive bubble 206 collapsed at the desired time, and that the print nozzle 102 is working in a proper manner. It may also be the case that the drive bubble detect module 104 determines that the decrease in the voltage 306 occurred after the ink_in time (as depicted by graph 306*b*). Such a scenario would typically arise when the drive bubble 206 did not collapse as planned and persisted for a longer period of time. In such a case, the drive bubble detect module 104 may attribute the same to a blocked nozzle condition.

The determination of whether the print nozzle 102 is blocked or not, may be provided by the drive bubble detect module 104 as the ink_in test result 110. The ink_in test result 110 may in turn be represented through binary values. For example, an ink_in test result 110 of 0 may indicate that the print nozzle 102 is blocked. On the other hand, an ink_in test result 110 of 1, could be used to indicate that the print nozzle 102 is not blocked. As per an example, previously discussed, the ink_out test result 108 and the ink_in test result 110 may be collectively used for determining whether the print nozzle 102 is functioning in the desired manner. For example, the drive bubble detect module 104 may provide the ink_out test result 108 and the ink_in test result 110 as a two bit output. The two bit output may be processed on the print head on which the print nozzle 102 is implemented, or may be communicated to the processing unit of the printer (say printer 101) for representing the condition of the print nozzle 102. Depending on the condition of the print nozzle 102, appropriate remedial action, such as servicing or replacing the print head, may be initiated.

The above examples which have been provided determine print nozzle condition based on determining as to how the voltage across the print nozzle varies at predefined time instants. The time instants are measured from the falling edge of the firing pulse. However, the time instants could also be measured from the leading edge of the firing pulse, without deviating from the scope of the present subject matter.

Figure 4:
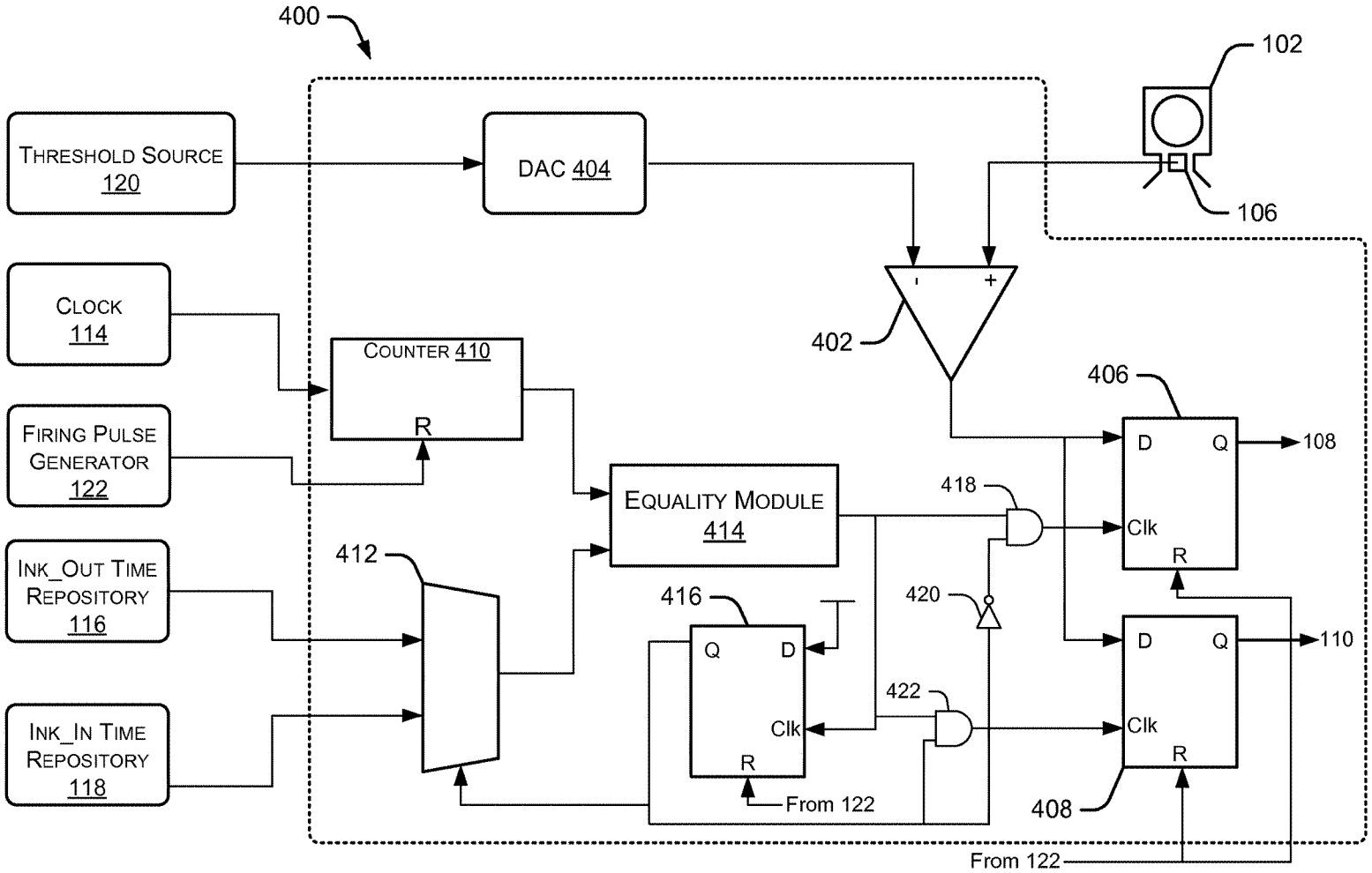
FIG. 4 illustrates a logical circuitry implemented on print head die for evaluating the condition of a print head nozzle, according to an example of the present subject matter.

FIG. 4 represents, according to an example of the present subject matter, a minimal logical circuitry 400 for determining print head nozzle conditions, implemented onto the print die. In one example, the circuitry 400 implements the functionality of the drive bubble detect module 104. As illustrated in FIG. 4, the print sensor 106 of a print nozzle, say the print nozzle 102, is coupled to the ink sensing module 124. The output of the ink sensing module 124 is provided to the positive terminal of a comparator 402. In one example, the ink sensing module 124 provides an analog signal based on the impedance or the voltage measured across the print nozzle 102 as a result of presence or absence of ink within the print nozzle 102. The other terminal of the comparator 402 is coupled to a Digital-to-Analog Convertor (DAC) 404. The DAC 404 receives the threshold voltage signal, such as threshold voltage 304, from a threshold source 120. The DAC 404 converts the digital threshold voltage signal 304 to analog, and provides it as an input to the negative terminal of the comparator 402.

As would be understood, any signal applied to the positive terminal of a comparator, such as the comparator 402, would be the basis for performing the comparison. For example, the output of the comparator 402 would be high, when the input from the DAC 404 (and consequently the threshold source 120) is less than the input received from the ink sensing module 124. Similarly, comparator 402 would provide a low out when the input provided by the DAC 404 is greater than the input received from the ink sensing module 124.

The output of the comparator 402 is provided to a first latch referred to as an ink_out latch 406, and second latch referred to as the ink_in latch 408. As illustrated, the ink_out latch 406 and the ink_in latch 408 are implemented using a D-type flip flop. However, other types of latches or flip flops may also be used without deviating from the scope of the present subject matter.

Continuing with the other components of the circuitry 400, the ink_out latch 406 and the ink_in latch 408 receive timing signals through a combination of a counter 410, a multiplexer 412, an equality module 414 and a test select latch 416. The combination of such components is further coupled to the ink_out latch 406 and the ink_in latch 408, respectively, through a series of AND and NOT gates. In one example, the test select latch 416 is also implemented using a D-type flip flop.

Each of the ink_out latch 406, ink_in latch 408, the counter 410, the equality module 414 and the test select latch 416 also includes a reset latch R. The reset latch of each of the aforementioned components is connected to the firing pulse generator 106. The counter 410 further is also coupled to the clock 114 which provides a clock signal, such as the clocked signal 310. The output of the counter 410 is provided as an input to the equality module 414. The other terminal of the equality module 414 is coupled to the multiplexer 412. The multiplexer 412 in turn receives input from the ink_in time repository 118 and the ink_out time repository 116. Returning to the equality module 414, its output is provided as a clocked input to the test select latch 416, and the ink_out latch 406 and the ink_in latch 408. In the present example, the input of the test select latch 416 is maintained at a constant high.

In one example, the circuitry 400 is further coupled to a single current source, via a pass FET (not shown) to the sensor 106 within the print nozzle 102. Such an example may be implemented in succession for a plurality of print nozzles which are being evaluated. In another example, a second pass FET may also be used for connecting the sensor 106 to the positive terminal of the comparator 402, thereby allowing the circuitry to be used for multiple print nozzles, such as print nozzle 102. In yet another example, the comparator 402 and the DAC 404 may also be employed for performing other functionalities, such as temperature control when not be used for evaluating condition of the print nozzle 102.

In operation, the output of the comparator 402 will provide a digital output as low when the ink is present within the print nozzle 102. As mentioned previously with ink being an electrical conductor, the impedance offered by the ink and consequently the voltage, such as voltage 306, across the print nozzle 102 will be low. As a result, the output of the comparator 402 will be logical low, or 0.

Similarly, when the ink is not present in the print nozzle 102, i.e., when a drive bubble, such as drive bubble 206, has formed, the impedance offered (and the voltage) will be high. The measure voltage will also be higher as compared to the threshold voltage 304. As a result, in such circumstances the output of the comparator 402 will also be logical high, or 1.

For evaluating the condition of the print nozzle 102, firing pulse, such as a firing pulse 302, is initiated. The firing pulse 302 includes a rising edge and a falling edge. For the duration when the firing pulse 302 is rising, the ink_out latch 406, ink_in latch 408, the counter 410 and the test select latch 416 are all reset. Once the edge of the firing pulse 302 falls, i.e., the firing pulse 302 goes low and terminates the resetting of the ink_out latch 406, ink_in latch 408, the counter 410 and the test select latch 416. At this stage, the counter 410 begins counting the clock cycles of clocked signal provided by the clock 104. The counter 410 uses the clocked signal, such as clocked signal 310, for monitoring the time that has elapsed from the instance the firing pulse 302 started going low.

As the evaluation of the print nozzle 102 is initiated, the test select latch 416 provides a select signal to the multiplexer 412 for selecting the ink_out time repository 116. As mentioned previously, at the time when the firing pulse 302 went low, the resetting of the test select latch 416 was terminated. At this stage, the output of the test select latch 416 is 0, which selects the ink_out time repository 116. In the present example, the multiplexer 412 allows selecting ink_out time repository 116 when the test select latch 416 outputs a logical low, and selects the ink_in time repository 118 when the test select latch 416 outputs a logical high.

With this, the multiplexer 412 selects the ink_out time repository 116 and provides the same to the equality module 414. The equality module 414 continuously compares the output of the counter 410 with the value provided by the ink_out time repository 116. The equality module 414 provides a high output or a 1, whenever the input to the equality module 414 matches. In the present case, the output of the equality module 414 would be 1, when the counts by the counter 410 matches with the value obtained from the ink_out time repository 116. At this stage, both the input terminals to gate 418 are high, which allows the ink_out latch 406 to latch onto and register, i.e., store the output of the comparator 402.

In addition, when the equality module 414 provides a high output to the test select latch 416, the test select latch 416 is set and provides a select signal for the ink_in time repository 118. Once selected, the equality module 414 continuously compares the output of the counter 410 with the value provided by the ink_in time repository 118. The equality module 414 provides a high output or a 1, when the counts by the counter 410 matches with the value obtained from the ink_in time repository 118. At this stage, since the output of the test select latch 416 is high, the ink_out latch 406 is not selected due to the NOT gate 420. However, both the input terminals to gate 422 are high, which allows the ink_in latch 408 to latch onto and register, i.e., store the output of the comparator 402.

A print nozzle, such as the print nozzle 102, would be considered to be functioning properly if the output ink_out test result 108 of the ink_out latch 406, is high and if the output of the ink_in test result 110 of the ink_in latch 408 is low. At this point the values of the two test result latches, i.e., ink_out test result 108 and ink_in test result 110 may be used by the printhead, or may be communicated to the printer either as two bits, or combined into one bit representing a healthy, or not healthy nozzle.

Table 1 provided below, provides a chart based on which the condition of the print nozzle, such as the print nozzle 102, is assessed according to an example of the present subject matter. The chart provides various issues which could be present with a print nozzle, such as the print nozzle 102, depending on ink_out test result 108 and ink_in test result 110.

TABLE 1

| ink_out test | ink_in test | Issue |
|---|---|---|
| 0 | 0 | Weak or no bubble |
| 0 | 1 | Unexpected |
| 1 | 0 | Normal |
| 1 | 1 | Nozzle blockage or ink inlet blockage |

Depending on the issue determined based on Table 1 above, appropriate remedial action may be initiated.

It should be noted that the above example has been provided is only illustrative and should not be construed as a limitation. Other examples are also implementable each of which would be within the scope of the present subject matter. For instance, instead of determining the time durations with respect to the falling edge of the firing pulse, the leading edge may also be considered. In such a case, the counter 410 may start counting the clock cycles with respect to the rising edge of the firing pulse. Other examples may further include extending the circuitry by adding additional time registers, test result latches, and an extra test state latch, so as to perform compares for more number of time durations, without deviating from the scope of the present subject matter.

Figure 5:
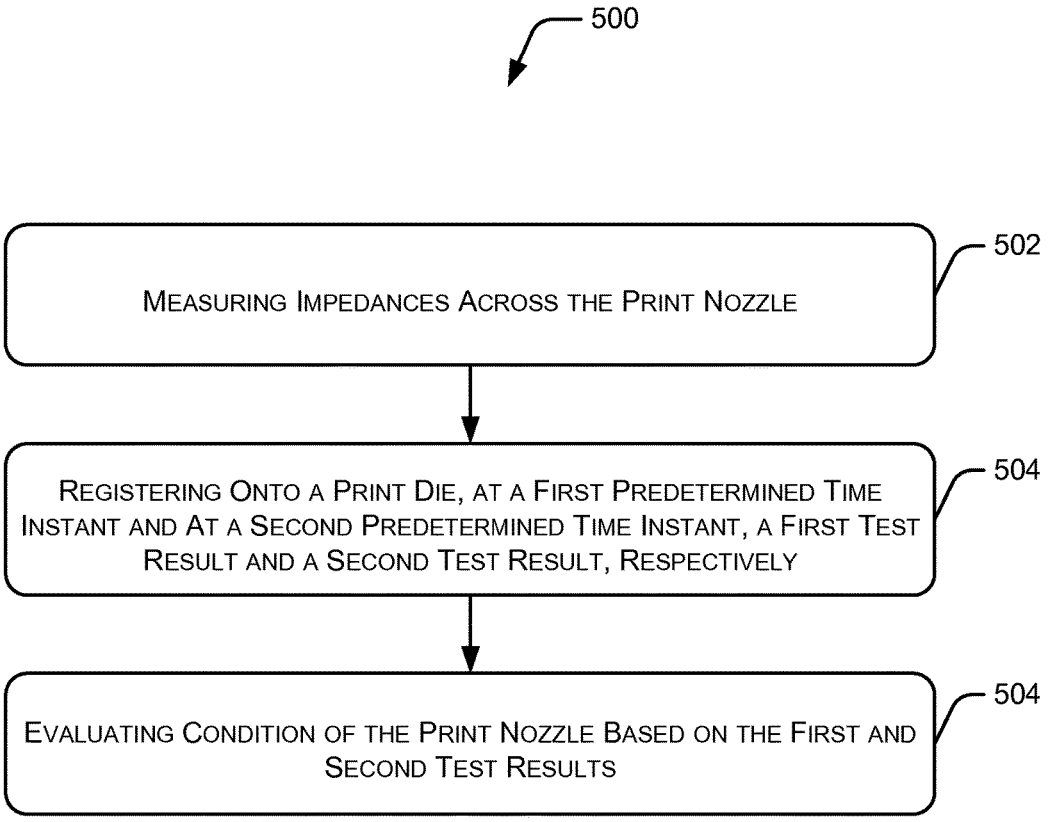
FIG. 5 illustrates a method of evaluating the condition of a print head nozzle, according to an example of the present subject matter

FIG. 5 illustrates a method 500 for evaluating the condition of a print head nozzle, according to an example of the present subject matter. The order in which the method 500 is described is not intended to be construed as a limitation, and any number of the described method blocks may be combined in any order to implement the method 500, or an alternative method.

Further, although the method 500 for evaluating the condition of a print head nozzle may be implemented in a variety of logical circuitry; in an example described in FIG. 5, the method 500 is explained in context of the aforementioned system 100.

Referring to FIG. 5, at block 502 impedances across a print nozzle are measured. For example, the ink sensing module 124 determines the impedance offered by a drive bubble 206 within the print nozzle 102. The impendence measured by the ink sensing module 124 may vary depending on whether the drive bubble 206 has formed or has collapsed.

At block 504, a first test result and a second test result are registered onto the print die. The first test result and the second test result are registered at a first predefined time interval and a second predefined time interval, and are determined based on the measured impedances. For example, the timing circuitry 112 may be employed for measuring impedances at the ink_out time instant and the ink_in time instant. In such a case, the timing circuitry 112 may measure the time that as elapsed from the occurrence of the firing pulse based on a clocked signal from clock 114. Once the time instants as prescribed by the ink_out time and the ink_in time have reached, the timing circuitry 112 may activate the drive bubble detect module 104 at these instances to determine a logical output. The logical output may be registered within the drive bubble detect module 104 as the ink_out test result 108 and the ink_in test result 110.

At block 506, the condition of the print nozzle is evaluated based on the first test result and the second test result. For example, based on the impedance measured by the sensor 106 at the first predetermined time instant, i.e., the ink_out time, and the second predetermined time instant, i.e., the ink_in time, the drive bubble detect module 104 determines the ink_out test result 108 and the ink_in tests result 110. Based on the test results 108, 110 the condition of the print nozzle 102 may be evaluated.

Figure 6:
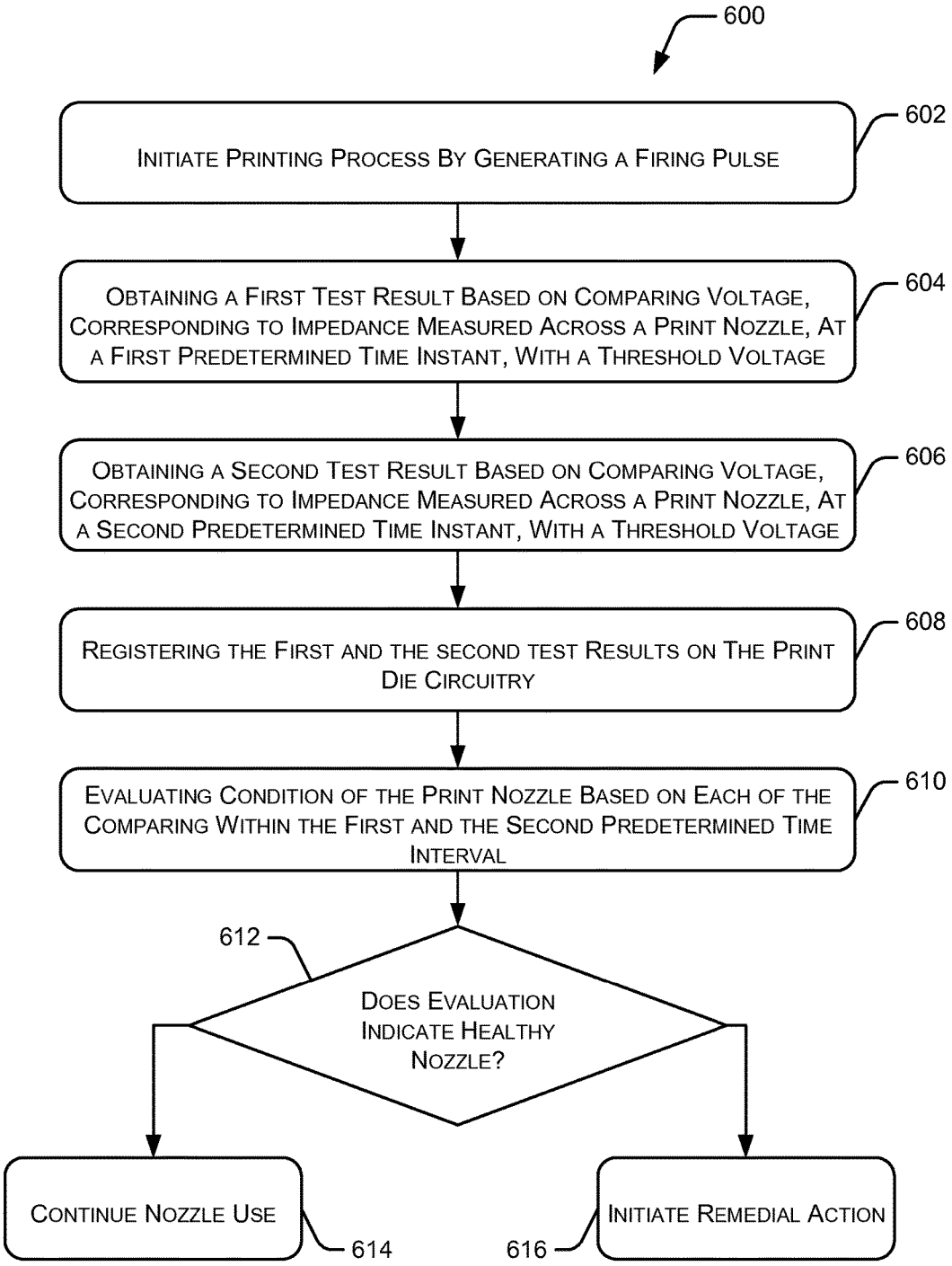
FIG. 6 illustrates another method of evaluating the condition of a print head nozzle, according to yet another example of the present subject matter.

FIG. 6 illustrates a method 600 for evaluating the condition of a print head nozzle, according to another example of the present subject matter. The order in which the method 600 is described is not intended to be construed as a limitation, and any number of the described method blocks may be combined in any order to implement the method 600, or an alternative method.

Further, although the method 600 for evaluating the condition of a print head nozzle may be implemented in a variety of logical circuitry; in an example described in FIG. 6, the method 600 is explained in context of the aforementioned circuitry 400.

At block 602, the printing process is initiated by generating a firing pulse. For example, on receiving a firing pulse 302, a heating element 202 within print nozzle 102 starts heating the ink. A drive bubble 206 is formed, which over a period of time, envelops sensor 106.

At block 604, electrical impedance is determined and its corresponding voltage is compared with a threshold voltage, at a first predetermined time instant based on which a first test result is obtained. In one example, the impedance is measured with respect to the falling edge of the firing pulse. For example, the first predetermined time instant, i.e., the ink_out time is obtained from the ink_out time repository 116. After the firing pulse 302, with the drive bubble 206 being formed, a volume of ink as well is in process of being ejected out of the nozzle. As illustrated in FIG. 4, a sensor 106 of a print nozzle, say the print nozzle 102, is coupled to the ink sensing module 124. The output of the ink sensing module 124 is provided to the positive terminal of a comparator 402. The other terminal of the comparator 402 is coupled to a threshold source 120 through a DAC 404. At the falling edge of the firing pulse 302, counter 410 begins counting the clock cycles provided by the clock 104. The test select latch 416 selects the ink_out time repository 116 through multiplexer 412.

The equality module 414 compares the output of the counter 410 with the value provided by the ink_out time repository 116, and provides a logical high whenever the input to the equality module 414 matches. At this stage, both the input terminals to gate 418 are high, which allows the ink_out latch 406 to store the output of the comparator 402. The output may be obtained as ink_out test result 108.

At block 606, electrical impedance is determined and its corresponding voltage is compared with a threshold voltage, at a second predetermined time instant, based on which a second test result is obtained. In one example, the impedance is measured with respect to the falling edge of the firing pulse. For example, the second predetermined time instant, i.e., the ink_in time is obtained from the ink_in time repository 118. Furthermore, at this stage, the drive bubble 206 should have collapsed, thereby renewing the contact of the ink with the sensor 106. As a result, the voltage measured would have decreased. With the multiplexer 412 having selected the ink_in time repository 118, the counter 410 continuously compares the output of the counter 410 with the value provided by the ink_in time repository 118. The equality module 414 provides a 1 at this instant, when the counts by the counter 410 matches with the value obtained from the ink_in time repository 118. Since both the input terminals to gate 422 are high, which allows the ink_in latch 408 to store the output of the comparator 402. The output may be obtained as ink_in test result 110.

At block 608, the first and the second test results are registered, i.e., stored within the print die. For example, the timing circuitry 112 may activate the drive bubble detect module 104 to register, i.e., store the ink_out test result 108 and the ink_in test result 110. In one example, the ink_out test result 108 and the ink_in test result 110 are stored within the registers of the drive bubble detect module 104. In another example, the registers for storing the ink_out test result 108 and the ink_in test result 110 are implemented using D-type flip flops.

At block 610, based on the combination of the test results, the condition of the print nozzle is evaluated. For example, both the ink_out test result 108 and the ink_in test result 110 are considered for evaluating the condition of the print nozzle 102.

At block 612, it is determined whether the condition of the print nozzle is healthy or not. For example, only if the ink_out test result 108 and the ink_in test result 110 are good, the condition of the print nozzle 102 is considered to be good ('Yes' path from block 612). In such case, the print nozzle 102 may be used subsequently (block 614). If in case it is determined that the either of ink_out test result 108 or the ink_in test result 110 is not good ('No' path from block 612), the condition of the print nozzle 102 is categorized as not good. Subsequently appropriate actions may be taken to either replace or repair the print nozzle 102 under consideration (block 616).

Although examples for the present subject matter have been described in language specific to structural features and/or methods, it is to be understood that the appended claims are not necessarily limited to the specific features or methods described. Rather, the specific features and methods are disclosed as examples of the present subject matter.

We claim:

1. A method for evaluating a condition of a print nozzle, the method comprising:

measuring impedances across the print nozzle;

registering onto a print die circuitry of the print nozzle, at least at a first predetermined time instant and at a second predetermined time instant, a first test result and a second test result, respectively, obtained based on the measured impedances, wherein each of the first predetermined time instant and the second predetermined time instant is measured with respect to a firing pulse; and evaluating the condition of the print nozzle based on the first test result and the second test result, wherein evaluating the condition of the print nozzle comprises determining that the print nozzle is functioning properly in response to the first test result having a logical high output, and the second test result having a logical low output.

2. The method as claimed in claim 1, wherein the first test result is obtained by comparing a voltage corresponding to the impedance measured at the first predetermined time instant with a threshold voltage.

3. The method as claimed in claim 2, wherein the second test result is obtained by comparing a voltage corresponding to the impedance measured at the second predetermined time instant with the threshold voltage.

4. The method as claimed in claim 1, wherein the first test result and the second test result are in the form of a logical output.

5. The method as claimed in claim 1, wherein:

the first test result is indicative of whether a drive bubble persisted at the first predetermined time instant; and the second test result is indicative of whether the drive bubble collapsed and ink within an ink chamber associated with the print nozzle replenished by the second predetermined time instant.

6. The method as claimed in claim 1, wherein the first predetermined time instant and the second predetermined time instant are measured with respect to a firing pulse based on a clocked signal.

7. A print head for a printer, the print head comprising:

a print nozzle;

a print die;

a drive bubble detect module provided onto the print die of the print head and communicatively coupled to the print nozzle, wherein the drive bubble detect module comprises:

a first latch on the print die to register, at a first predetermined time instant, a first test result obtained based on a voltage measured across the print nozzle, a second latch on the print die to register, at a second predetermined time instant different from the first predetermined time instant, a second test result obtained based on a voltage measured across the print nozzle, and the drive bubble detect module to evaluate a condition of the print nozzle based on the first test result and the second test result, wherein the drive bubble detect module is to determine that the print nozzle is functioning properly in response to the first test result having a logical high output, and the second test result having a logical low output; and a timing circuitry coupled to the drive bubble detect module and to activate the drive bubble detect module, at the first predetermined time instant and the second predetermined time instant, to register respectively the first test result and the second test result.

8. A print head for a printer, the print head comprising:

a print nozzle;

a drive bubble detect module provided onto a print die of the print head and communicatively coupled to the print nozzle, wherein the drive bubble detect module is to:

register onto the print die, at a first predetermined time instant, a first test result obtained based on a voltage measured across the print nozzle, register onto the print die, at a second predetermined time instant, a second test result obtained based on a voltage measured across the print nozzle, wherein the drive bubble detect module is to provide each of the first test result and the second test result as a binary output, and determine a condition of the print nozzle based on the first test result and the second test result, wherein the drive bubble detect module is to determine the print nozzle to be functioning properly when the first test result is a logical high output and the second test result is a logical low output; and a timing circuitry coupled to the drive bubble detect module and to activate the drive bubble detect module, at the first predetermined time instant and the second predetermined time instant, to register respectively the first test result and the second test result.

9. The print head as claimed in claim 7, wherein the timing circuitry is to measure the first predetermined time instant and the second predetermined time instant with respect to an occurrence of a firing pulse.

10. The print head as claimed in claim 7, wherein the drive bubble detect module is further communicatively coupled to a time repository, and wherein the timing circuitry further comprises a multiplexer for obtaining one of the first predetermined time instant and the second predetermined time instant.

11. The print head as claimed in claim 8, wherein the drive bubble detect module further comprises a first latch to register the first test result, and a second latch to register the second test result.

12. A printer comprising:

a print head as claimed in claim 7.

13. The print head as claimed in claim 7, wherein the timing circuitry is to measure the first predetermined time instant and the second predetermined time instant based on a number of clocked cycles with respect to a firing pulse.

14. The method of claim 1, wherein registering the first test result and the second test result onto the print die circuitry comprises storing the first test result and the second test result in latches on a print head die of the print die circuitry.

15. The method of claim 1, wherein the logical high output of the first test result indicates that a drive bubble has formed in the print nozzle, and the logical low output of the second test result indicates that ink is present in the print nozzle after collapse of the drive bubble.

16. The method of claim 1, wherein the evaluating is performed by the print die circuitry that is part of a print head die.

17. The method of claim 16, wherein the print head die is separate from a processor of a printer system.

18. The print head of claim 7, wherein the logical high output of the first test result indicates that a drive bubble has formed in the print nozzle, and the logical low output of the second test result indicates that ink is present in the print nozzle after collapse of the drive bubble.

* * * * *